US005284119A

United States Patent [19]

Smitley

[11] Patent Number: 5,284,119

[45] Date of Patent: Feb. 8, 1994

[54] INTERNAL COMBUSTION ENGINE FUEL INJECTION APPARATUS AND SYSTEM

[75] Inventor: Marion L. Smitley, Birmingham, Mich.

[73] Assignee: Walter Potoroka, Sr., Oakland, Mich.

[21] Appl. No.: 911,476

[22] Filed: Jul. 10, 1992

Related U.S. Application Data

[63] Continuation-in-part of Ser. No. 726,788, Jul. 8, 1991.

[51] Int. Cl.[5] ..... F02M 37/04

[52] U.S. Cl. ..... 123/497; 123/506

[58] Field of Search ..... 123/497, 458, 506, 494, 123/499

[56] References Cited

U.S. PATENT DOCUMENTS

| | | | |
|---|---|---|---|
| 3,822,677 | 7/1974 | Reddy | 123/497 |
| 3,827,409 | 8/1974 | O'Neill | 123/458 |
| 3,844,263 | 10/1974 | Endo | 123/458 |
| 3,949,713 | 4/1976 | Rivere | 123/458 |
| 3,949,714 | 4/1976 | Mitchell | 123/458 |
| 4,064,855 | 12/1977 | Johnson | 123/458 |
| 4,109,669 | 8/1978 | Rivere | 123/458 |
| 4,248,194 | 2/1981 | Drutchas | 123/497 |
| 4,260,333 | 4/1981 | Schillinger | 123/497 |
| 4,800,859 | 1/1989 | Sagisaka | 123/497 |
| 4,926,829 | 5/1990 | Tuckey | 123/497 |

*Primary Examiner*—Carl S. Miller

*Attorney, Agent, or Firm*—Walter Potoroka, Sr.

[57] ABSTRACT

The proposed fuel injection system for gasoline engines eliminates or reduces the excessive fuel by-pass of current systems by use of an engine driven fuel pump or by modulating fuel pump speed and fuel delivery so as to be directly proportional to engine speed.

16 Claims, 7 Drawing Sheets

INTERNAL COMBUSTION ENGINE FUEL INJECTION APPARATUS AND SYSTEM

RELATED APPLICATION

This application is a continuation-in-part of U.S. application Ser. No. 07/726,788 filed Jul. 8, 1991 in the name of Marion L. Smitley.

This invention relates to engine fuel systems, and more particularly to an electronic fuel injection system and apparatus for supplying a highly volatile fuel, such as gasoline or a reformulated gasoline mixture (as opposed to a less volatile fuel, such as diesel oil) to an associated internal combustion engine.

BACKGROUND OF THE INVENTION

Current cars, trucks and other vehicles or devices driven by gasoline-fueled internal combustion engines include an on-board computer to provide means for electronically controlling the various systems and devices incorporated in these vehicles.

As is well known in the art, and as explained in copending U.S. patent application Ser. No. 07,662,568 and the above Ser. No. 07/726,788, the basic components of a typical prior art electronically-controlled gasoline fuel injection system in such vehicles are generally as follows:

1. a fuel tank;
2. an electric fuel pump;
3. a pressure regulator for maintaining the pressure of the fuel supplied by the fuel pump at a required constant pressure;
4. sensors appropriately mounted on the engine or vehicle, each producing an electrical signal representative of the instantaneous value of one of the various conditions under which the engine must operate, and in accordance with which the quantity of fuel supplied to the engine is to be controlled;
5. a solenoid-operated or other suitable electronically-controlled fuel injector(s) for supplying a metered quantity of the pressure-regulated fuel to the engine induction system or directly to the individual engine cylinders;
6. an electronic control unit (ECU), which may be part of the on-board computer, for receiving, as inputs thereto, the electric signals generated by the sensors and producing, as the output therefrom, an integrated electrical signal controlling the injector(s);
7. a direct current electrical power source, such as a battery and/or an alternator;
8. appropriate electrical switches and conductors connecting the electrical/electronic components (electrical circuit) of the system; and
9. appropriate fuel conduits connecting the fuel components (hydraulic circuit) of the system. Examples of such a typical prior art systems are taught, as explained in U.S. Ser. No. 07,662,568, by the following U.S. Pat. Nos.:

| | | |
|---|---|---|
| 4,292,945 | 4,590,911 | 4,878,418 |
| 3,604,401 | 4,532,893 | 4,109,669 |
| 4,265,200 | 2,108,115 | |

Persons skilled in the internal combustions engine art understand the following principles relating thereto:

a) at any given speed (RPM), the engine may be developing minimum, intermediate or maximum power;
b) engine fuel consumption varies, and, at any given speed, fuel consumption depends upon the power taken out of the engine;
c) speed and power requirements determine fuel consumption and
d) even at engine idle speed which usually involves low fuel consumption, more vehicle accessories in operation requires more power, and thus increased fuel consumption.

However, it is a fact that the quantity of fuel consumed by the engine is dependent mainly upon engine speed. As shown later in this specification, fuel consumed by the engine varies with different loads, but a change in engine speed (RPM) results in the most significant change in fuel consumption. In other words, while cold ambient temperatures and other power-demanding equipment increase the fuel consumption, by far, the greatest factor effecting fuel consumption is engine speed.

The fuel pump component of current state-of-the-art gasoline injection systems is typically a constant speed, positive displacement electric pump driven by a d.c. electric motor activated by turning the vehicle ignition switch to the ON position and designed to continuously (so long as the ignition switch is ON) supply the maximum quantity of fuel that will possibly ever be required by the engine under the most severe conditions of speed, load, low ambient temperature, etc., with all other power-demanding systems (air conditioning, heater, radio, lights, windshield wipers, etc.) operating.

However, since much more than 50% (possibly as much as 90%) of normal vehicle operation requires only a very small portion (possibly about 20%) of the above-mentioned continuous, total, maximum-required fuel pump output, it is necessary to by-pass the excess fuel (pumped to 30–40 psi) that is not required by the engine during most normal operating conditions back to the fuel tank or to sump pressure, through a by-pass conduit that normally carries a much greater volume of fuel than the conduit carrying fuel to be consumed in the engine cylinders. Obviously, total pumped fuel equals consumed fuel plus by-passed fuel, and it does not make sense to pump, at low curb idle engine speed and power, as when stopped at a red traffic signal with no accessories operating, the quantity of fuel required at wide-open throttle (WOT) high engine speed operation, with all accessories operating. Such by-pass of most of the pumped fuel (hereinafter referred to as "EXCESSIVE" by-pass) should be either completely eliminated, as proposed in the above-referenced U.S. application Ser. No. 07,662,568, or reduced to a minimum, which is a main object of this invention.

As explained in U.S. application Ser. No. 07,662,568, such EXCESSIVE fuel by-pass creates serious inherent problems, such as the following, for example:

(a) For one thing, substantial energy (gasoline to provide the power required to operate the pump) is being wasted pumping fuel to approximately 30–40 psi, and consuming very little (about 20%) of the total pumped fuel.
(b) More importantly, vapor is being churned out of the fuel, which is undesirable and must be dealt with.
(c) Especially importantly, pumping any fluid to a high pressure creates heat that must be dissipated somehow. This is specially true in gasoline engines where the injectors are designed to and must meter liquid fuel, rather than fuel vapors.

It is understood that various automotive vehicle manufacturers and others are going to the expense of trying to develop means to overcome vapor and other hot fuel handling problems that complicate the metering function.

(d) Additionally, pumping maximum fuel at the required pressure causes unnecessary motor/pump wear.

The need to increase automotive fuel efficiency, to reduce noxious automotive exhaust emissions, to improve automotive engine performance, to meet world competition and ecological standards, and to conserve energy, is a continuing need of ever increasing importance that will not go away. In fact, it is understood that the U.S. patent and other laws provide for special considerations, such as expedited handling and mandatory licensing, regarding patent applications/patents covering inventions relating to conservation of energy.

Further, the automotive/gasoline industries are so huge that seemingly minute improvements in a single automobile produces astronomical results, when multiplied by the world vehicle population.

The importance of fuel economy is evidenced by the fact that a prominent automobile manufacturer recently announced it's plan to market a vehicle having a system to shut off the engine when it is not needed, such as when stopped at a traffic light or when coasting downhill, and to restart the engine when needed. Reportedly, the system development indicates feasibility, a main remaining problem being public acceptance of the concept.

Such matters are the very essence of the responsibilities of the U.S. Environmental Protection Agency (EPA) and Department of Energy, as well as various state agencies such as the California Air Resources Board (CARB) to which the EPA looks for leadership in the matter of air pollution control.

Prior to present day electronic gasoline fuel metering, an engine-driven fuel pump was used to supply fuel to the fuel bowl(s) of a carburetor, and the pump supplied only the amount of fuel required (being consumed) by the engine. This pump was unique, in that it was truly a variable displacement pump which pumped fuel only on demand, so that the fuel system did not require a fuel by-pass conduit back to sump pressure or the fuel tank.

However, the above diaphragm pump became impractical and obsolete with the advent of electronic fuel metering systems, since the fuel pressure requirement was increased from about 4–6 psi to about 30–40 psi, and the present day electric fuel pumps described above were substituted, at least in part to enhance electronic fuel system control, resulting in the above problems. It is believed that there have not been, and that there are not now, any engine-driven, gasoline fuel pumps in use, providing the fuel pressures necessary for current fuel injection systems.

OBJECTS OF THE INVENTION

One of the main objects of the invention is to provide an electronic gasoline (as used throughout herein, "gasoline" means any volatile liquid fuel, such as, for example, 100% gasoline or any reformulated gasoline mixture) fuel supply system capable of eliminating such EXCESSIVE by-passing of fuel, and eliminating or greatly reducing any fuel by-pass.

Another main object of the invention is to provide a by-pass type electronic gasoline fuel metering system that eliminates or limits the excess pumped fuel, thereby eliminating the above-described inefficient EXCESSIVE continuous pumping and by-passing of maximum fuel in current state-of-the-art systems.

Still other broad and specific objects of the invention are to provide such gasoline systems as follows:

(1) having means such that although the d.c. pump drive motor speed is constant, the driven pump speed is controlled to a speed proportional to vehicle engine speed;

(2) wherein the positive displacement pump is driven by a d.c. electric motor, but wherein the drive connection between the d.c. motor and the pump comprises means adapted to drive the fuel pump at a speed directly proportional to engine speed;

(3) wherein the drive connection means between the motor and the pump comprises a magnetic clutch, and wherein means is provided for controlling the operation of the clutch in a manner so that the d.c. motor effectively drives the pump at a speed directly proportional to engine speed;

(4) wherein proper fuel metering is dependent upon maintenance of a constant required system fuel pressure, as by a pressure regulator, but wherein the quantity of fuel supplied by the fuel pump is in direct proportion to engine speed;

(5) wherein a d.c. electric motor drives a positive displacement fuel pump, the drive connection between the motor and the pump being designed and controlled so as to be infinitely variable and adaptable to drive the pump at a speed that is continuously directly proportional to the instantaneous value of engine speed, so as to eliminate EXCESSIVE by-passed fuel;

(6) wherein the pump speed is dependent upon the value of at least one other engine operating parameter, or a combination of other engine operating parameters, so as to reduce the quantity of by-passed fuel or even completely eliminate the need to by-pass any fuel;

(7) wherein the pump drive connection includes a variable magnetic clutch, being variably controlled electronically, whereby the drive motor can function independently of the driven pump, such that even though motor speed may at times vary for reasons such as varying applied power voltage caused by varying loads on the electrical system, the fuel pressure in the pump discharge line will remain constant, possibly even in a no by-pass system, such as taught in U.S. Ser. No. 07,662,568, but by means other than d.c. drive motor control, since the magnetic clutch will compensate for variations in power voltage and/or wear in the drive motor and/or pump;

(8) wherein the fuel pump assembly comprises at least two electrical components, one component being the d.c. electric drive motor and the other component being an electrically operated and controlled drive connection between the drive motor and the pump, whereby the motor and the pump can operate or be controlled independently so that, for example, motor speed can be controlled by a single or integrated voltage input, variable in accordance with a single or plurality of sensed parameters, the controlled components cooperating to provide the desired fuel quantity to the fuel injector(s);

(9) wherein the fuel pump is a positive displacement pump driven by the engine (as opposed to the d.c. motor-driven pump) and designed to pump a quantity of fuel directly proportional to engine speed, whereby, in contrast to the above-described present day system, the quantity of pumped and by-passed fuel is greatly reduced, thereby greatly reducing the disadvantages and problems of present day EXCESSIVE by-pass systems;

(10) wherein the pump is driven in any suitable manner (as by gear, clutch, chain, or belt, for example) by any engine part (ignition distributor, cam shaft, or the like) operating in direct proportion to engine speed;

(11) wherein (a) the pump drive motor and (b) the drive motor/pump drive mechanism are separately powered and controlled so as to be capable of independent speed adjustment, and the speed of one is modified by the speed of the other;

(12) wherein a fuel pump is driven at a speed directly proportional to engine speed supplying fuel to the engine (consumed fuel) and a by-pass means returns excess fuel not required by the engine (by-pass fuel) to the fuel tank or sump, the pump being driven at a variable speed directly proportional to variable actual engine speed, rather than at a constant maximum speed required to supply the maximum quantity of consumed fuel the engine could ever require, whereby the quantity of fuel being by-passed is eliminated or substantially less that the EXCESSIVE quantity by-passed in current systems;

(13) wherein the system eliminates by-pass of substantial quantities of fuel required at WOT when actual engine speed is low, such as curb idle speed;

(14) wherein proper fuel metering is dependent upon maintenance of a constant required system fuel pressure, as maintained by a pressure regulator, but wherein the quantity of fuel supplied by the fuel pump is is direct proportion to the engine speed.

A still further object of the invention is to provide easily installed aftermarket apparatus and means for modification of current EXCESSIVE fuel by-pass systems, to greatly reduce the quantity of fuel by-passed therein, such modification apparatus and means requiring a minimum modification of such current EXCESSIVE fuel by-pass systems.

Another object of the invention is to provide aftermarket kit method and means for adapting or modifying a current EXCESSIVE fuel by-pass system to a system embodying the invention, wherein a minimum of excess fuel is pumped and by-passed, thereby reducing or eliminating the above-mentioned problems of an EXCESSIVE by-pass system.

Still another object of the invention is to easily provide such a system with minimum modification of existing EXCESSIVE by-pass systems.

Additional main and specific objects of the invention are to provide original equipment and/or apparatus and means for after market retrofit of current in-use EXCESSIVE fuel by-pass systems, wherein:

(a) means are provided wherein the speed of a fuel pump driven by a variable speed electric motor is controlled in accordance with pressure and/or flow conditions in the fuel by-pass conduit, (b) use is made of a variable supply of fuel to not only supply the quantity of fuel required to maintain the correct pressure in the injector supply conduit, but to supply that amount of fuel plus some quantity of fuel "Q" to make sure that the by-pass valve (pressure regulator) is always by-passing some, but a minimum, amount of fuel, (c) the fuel "Q" in above (b) is dependent upon and determined by the effect of transient conditions and the inability of a variable fuel supply systems to maintain the system design fuel pressure in the injector fuel supply conduit, (d) the fuel "Q" in (b) above is minimal as compared to the EXCESSIVE by-pass in current systems, (e) the means in (a) above includes a pressure transducer and a down stream restriction for the fuel by-pass conduit, the transducer transmitting pressure signals to an electronic control unit, which, in turn, transmits speed control signals to a variable speed electric motor/fuel pump assembly, (f) the means in (a) above includes a flow transducer in the by-pass conduit, the transducer transmitting signals to an electronic control unit, which, in turn, transmits speed control signals to the motor/pump assembly referred to in (e), (g) the means in (a) above includes a differential pressure transducer sensing and transmitting signals representative of the differential between the pressure in the injector feed conduit and the by-pass conduit to the electronic cotrol unit, which, in turn transmits speed control signals based on the differential pressure signals, to the motor/pump assembly, and (h) the variable speed electric motor/fuel pump assembly referred to above contemplates possible use of a constant speed electric motor driving the pump through a magnetic clutch, as already referred to above.

The above, and various other general and specific objects and advantages of the invention will become apparent when reference is made to the following detailed description, considered in conjunction with the accompanying drawings, wherein like elements are designated by the same reference numerals.

Some of the above-referenced prior art patents concern compression ignition, diesel fuel engines, which operate at a much higher fuel pressures and with much less volatile fuel, so that the disadvantages of fuel by-pass experienced in the lower pressure and more volatile fuel gasoline engines are not experienced. In other words, diesel engine fuel systems are from a completely different art, as evidenced by the fact that diesel engine mechanics attend a diesel engine school and do not service gasoline engines, and vice versa.

It is believed that all current production gasoline powered cars and trucks with electronic fuel metering systems have such EXCESSIVE by-pass systems, whatever the other specific structural details thereof might be, and experience the above-mentioned problems..

BRIEF DESCRIPTION OF THE VARIOUS FIGURES OF THE DRAWINGS

Figure 1:
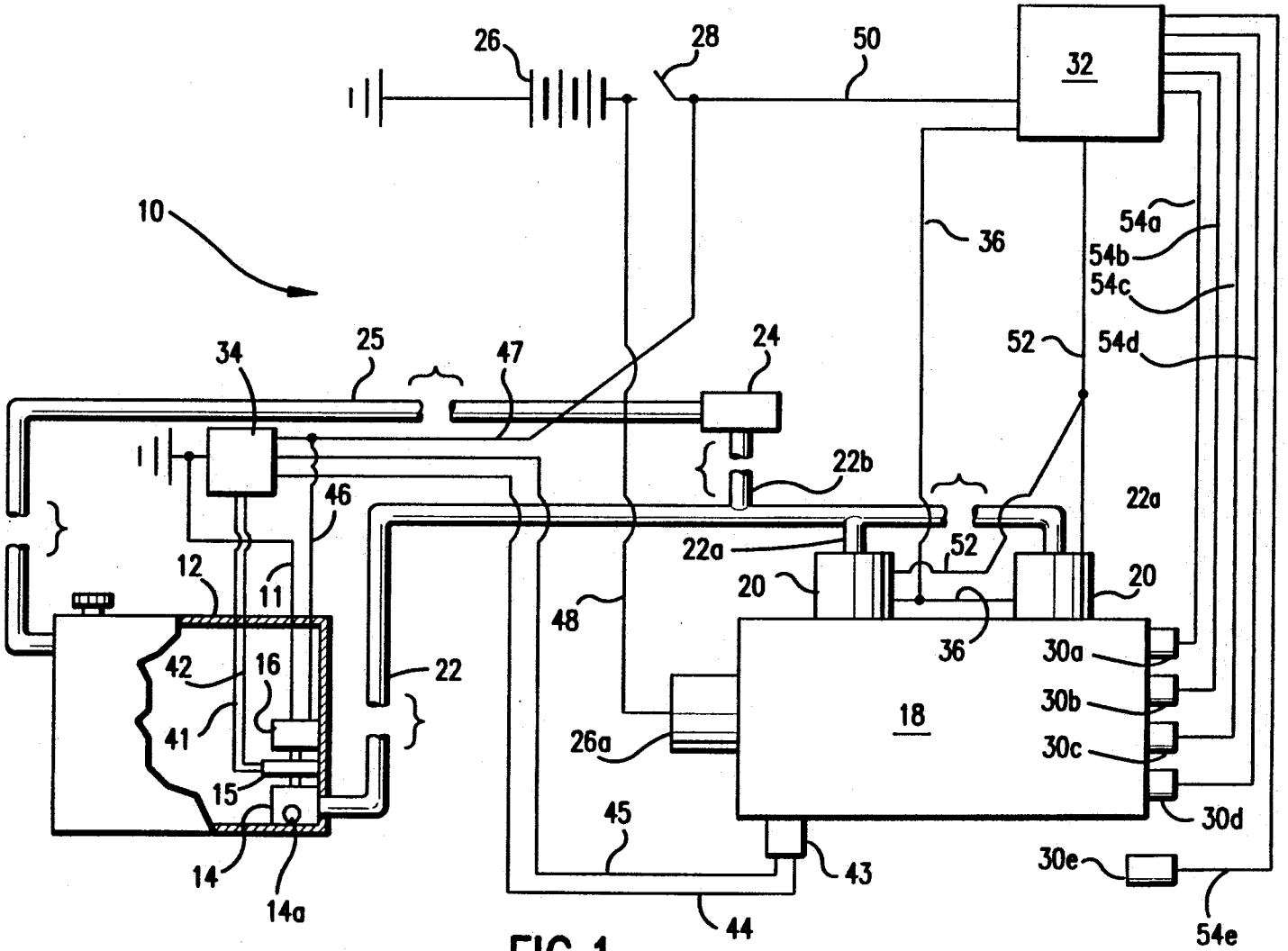
FIG. 1 is a schematic block diagram of a first embodiment of the invention.

Certain details and/or elements not shown in the drawings are considered to be matters already known in the prior art, as exemplified in the prior art patents referred to herein, or which can be supplied by the application of ordinary skill in the electronics or other arts.

DETAILED DESCRIPTION OF THE INVENTION

With the above background, and referring now to FIG. 1 of the appended drawings, it will be seen that a first embodiment of an electronic fuel injection system 10 contemplated by the invention comprises a gasoline fuel tank 12, a fuel pump 14 driven by an electric motor 16, through a magnetic clutch drive device 15, the pump being commonly, but not necessarily, mounted in the fuel tank 12. The associated gasoline-fueled internal combustion engine 18 has one or more electronically-controlled fuel metering valves 20 (commonly called fuel injectors) and an unmetered fuel conduit 22 having branch conduit(s) **22*a* extending between the pump 14 and the injector(s) 20 and a branch conduit 22*b* leading to a fuel pressure regulator 24 adapted to by-pass fuel back to the tank whenever pressure in the line 22 exceeds the designed pressure (30–40 psi. or other required pressure) for the injectors 20, thereby maintaining pressure in line 22*a* at the designed constant. Engine speed (RPM) sensor 43 mounted on the engine at any convenient place senses engine speed (RPM) and sends signals through leads 44 and 45 to ECU 34, which, in turn, controls magnetic clutch 15 slippage through leads 41 and 42 so that the speed of the pump 14 is controlled to be in proportion to engine 18** speed (RPM).

Except for the structure associated with magnetic clutch 15 and pressure regulator 24 AND by-pass conduit 25, FIG. 1 is otherwise similar to the drawing in U.S. application Ser. No. 07,662,568.

Further, except for speed sensor 43, electronic control unit 34 and the structure relating to magnetic clutch 15, the above-described structure is similar to that of current prior art systems, and, while shown separately, it is apparent that electronic control unit 34 could be incorporated as a part of or within the computer 32.

It is contemplated that the invention is not limited to use of any particular injector, pump or motor designs, which are well known in the art—that is, any of the specific well-known designs that will provide the objects of the invention is contemplated.

As in current systems, the electrical/electronic circuit of the fuel injection system 10 may comprise the usual direct current source, such as a battery 26 and alternator **26*a*, an ignition switch 28, one or more sensors 30*a–e*, each sensor usually being adapted to sense the instantaneous value of a separate ambient or engine operating condition in accordance with which consumed fuel is to be supplied to the engine 18 and to generate an electrical signal (preferably a voltage signal) representative of such value, the injector(s) 20 already referred to above, and an electronic on-board computer means 32. The prior art computer 32 is adapted to receive the sensor signals as inputs thereto and to generate an instantaneous and continuous integrated variable electrical output for controlling the injector(s) or other suitable metering means 20** in a manner to provide exactly the proper required quantity of fuel for all sensed ambient and/or engine operating conditions.

The invention contemplates, for example, and without limitation thereto, use of a common injector structure that includes a so-called duty cycle solenoid-operated (ON-OFF) valve that varies the quantity of fuel supplied to the engine, in accordance with the time that the valve is ON (open), the fuel being at a predetermined constant pressure, as determined by the fuel pressure regulator.

It should and will be noted that the system 10 includes the fuel pressure regulator 24, by-pass conduit 25 and a speed sensor 43 adapted to continuously sense the engine 18 speed (RPM) and provide a continuous electrical signal representative of instantaneous engine speed (RPM) as an input to the ECU 34, as taught in U.S. Ser. No. 07,662,568, which, in turn, provides a variable electrical output signal that varies (adjusts) the slippage of clutch 15 driving the pump (rather than the speed of motor 16, as is taught in U.S. Ser. No. 07,662,568) so as to maintain the pump speed directly proportional to engine speed, the pump being designed to provide some small quantity (safety factor) of fuel in excess of the maximum fuel required at any given speed. Such expected small by-passed fuel quantity is, however, much less than the EXCESSIVE fuel by-pass of present systems.

The amount of fuel consumed in an engine varies depending upon various operating conditions, which, in turn tends to raise or lower the pressure in the fuel line 22 supplied by the positive displacement pump 14, for which the pressure regulator 24 in today's EXCESSIVE by-pass systems compensate by means of by-passing more or less fuel back to the tank 12 or the pump inlet.

It is important to note, in FIG. 1, that the pump is driven by power transmitted to motor 16 through conductors 11/46 and 47 when the ignition switch 28 is closed, while the voltage signal to clutch 15 is transmitted from control 34 through leads 41/42, as a result of signals from sensor 43 transmitted through leads 44/45. With this arrangement, motor 16 and pump 14 can function independently.

Specific magnetic clutch designs in applications other than fuel systems are well known in the art, an example of the art of magnetic clutch use in a non-fuel system application being taught in U.S. Pat. No. 4,267,951.

As contemplated under the invention, the pump motor 16 could be fed vehicle electrical system 12 volts d.c., in which case a positive displacement pump, of a particular design and without the magnetic clutch 15 feature, would be driven at a constant speed and deliver a known constant volume of liquid fuel, in the absence of fuel vapors therein, a problem that the invention seeks to eliminate. However, the proposed magnetic clutch 15 can be fed any desired voltage signal to alter the clutch slippage, and thus the pump speed and fuel delivery, even though the motor is operating at a constant speed. That is, the motor and pump operation (speeds) can be made independent of each other, in response to independent, variable voltage signals, each responsive to one or more sensed operating conditions, which can be processed through a suitable electronic control system such as the computer 32 and/or the ECU 34, as the vehicle manufacturer may desire.

It can thus be seen that the magnetic clutch 15 or other similar or equivalent means can provide the interface between the driving motor 16 and the driven pump 14 to greatly enhance the utility thereof in fuel management. More specifically, it is contemplated that such an arrangement can be used to greatly reduce or eliminate the problems caused by EXCESSIVE fuel by-pass to the extent that once automobile manufacturers and/or governmental agencies become aware of the fact that current fuel injection systems needlessly constantly by-pass so much of the fuel being pumped (often, is more fuel than is being consumed in the engine), they will take steps to eliminate such EXCESSIVE by-pass.

It has been stated recently in the news media, for example, that an increase of one mile per gallon in the fuel economy of all U.S. motor vehicles would result in a reduction of millions of barrels of crude oil used per day, totalling several times per day the capacity of the tanker involved in the Alaska (Valdez) oil spill, which is a worthy objective.

U.S. Ser. No. 07,662,568 proposes that electric fuel pump speed be varied to maintain a constant predetermined pressure in the unmetered fuel conduit connected to the injectors. This is accomplished by sensing the pressure in the supply line 22 with a pressure sensor 24 and feeding sensor-generated electric signals to an electronic control 34, which in turn feeds electric signals to the electric motor 16 to adjust motor speed so that the output pressure in line 22 is always maintained at the predetermined pressure for which the injectors 20 were designed (without the use of a pressure regulator/excess fuel by-pass means), the object being to eliminate the need for pumping excess fuel and by-passing the same back to the tank.

The invention disclosed herein accomplishes a similar object by providing a unitary pump assembly including the magnetic clutch variable drive 15 between the motor 16 and the pump 14. The motor is powered by the vehicle 12 volt electrical system, as in the case of prior art systems. However, the speed sensor 43 transmits an electrical signal to the electronic control unit 34, which, in turn, controls the magnetic clutch 15, as already described above regarding FIG. 1. That is, the pump motor 16 and pump 14 can function independently, so that even though motor speed may vary with different loads of the electrical system, the pressure in conduit 22 will remain constant, since the magnetic clutch 15 is controlled to, and will, compensate for variations in power voltage and/or wear in the motor, for example.

Figure 2:
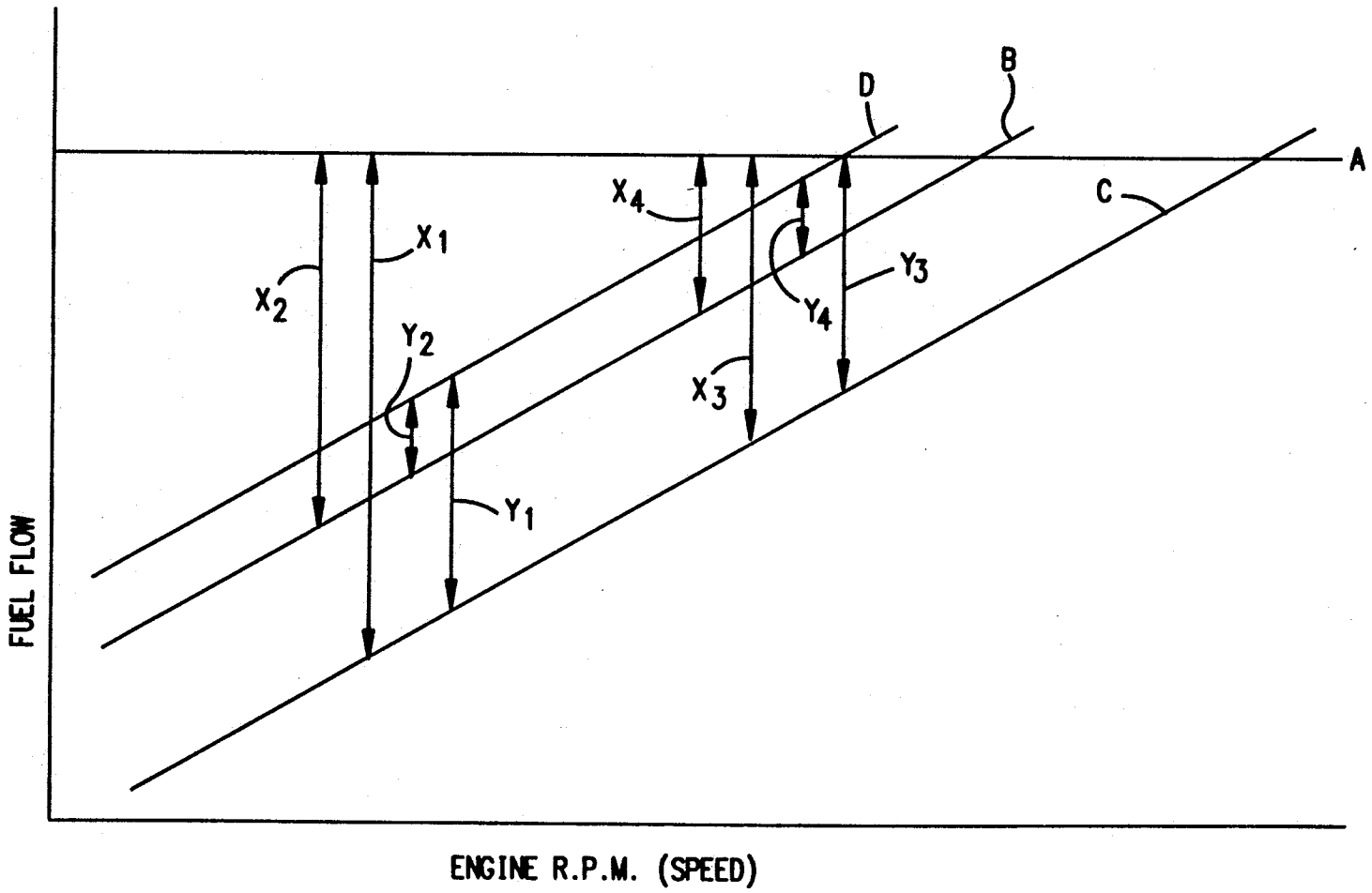
FIG. 2 is a graph qualitatively illustrating operational characteristics of the invention.
Figure 3:
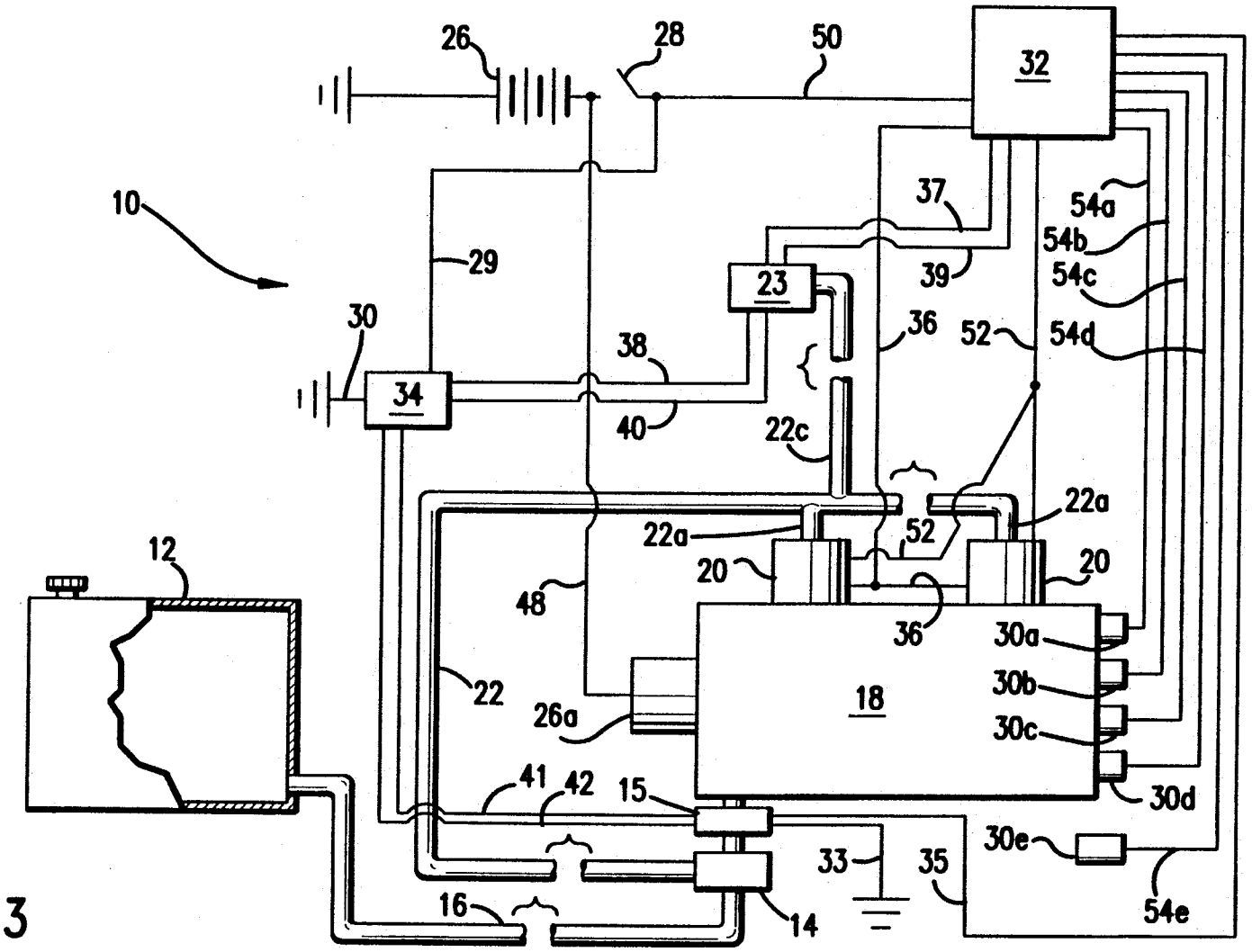
FIG. 3 is a schematic block diagram of a second embodiment of the invention.
Figure 4:
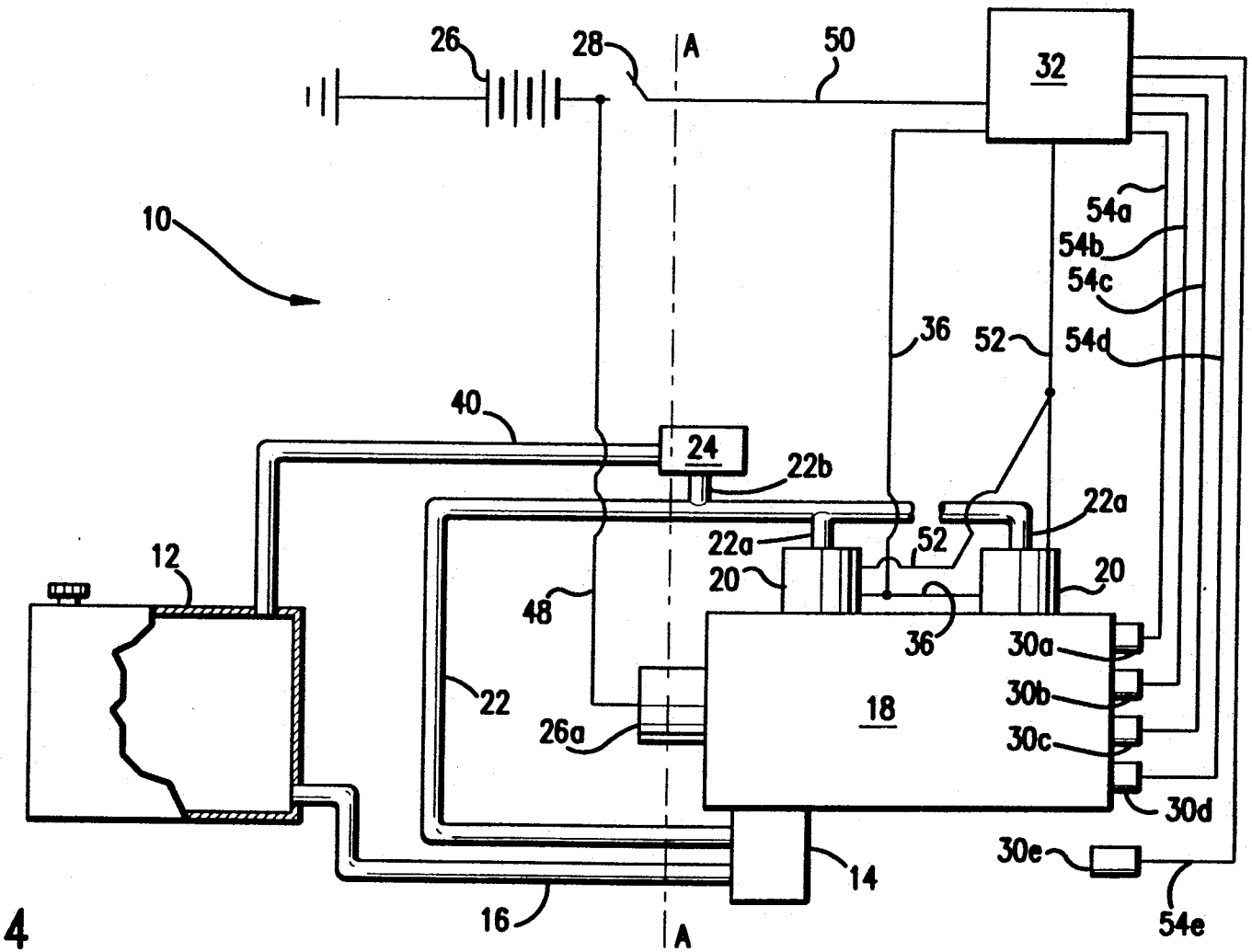
FIG. 4 is a schematic block diagram of a third embodiment of the invention.
Figure 5:
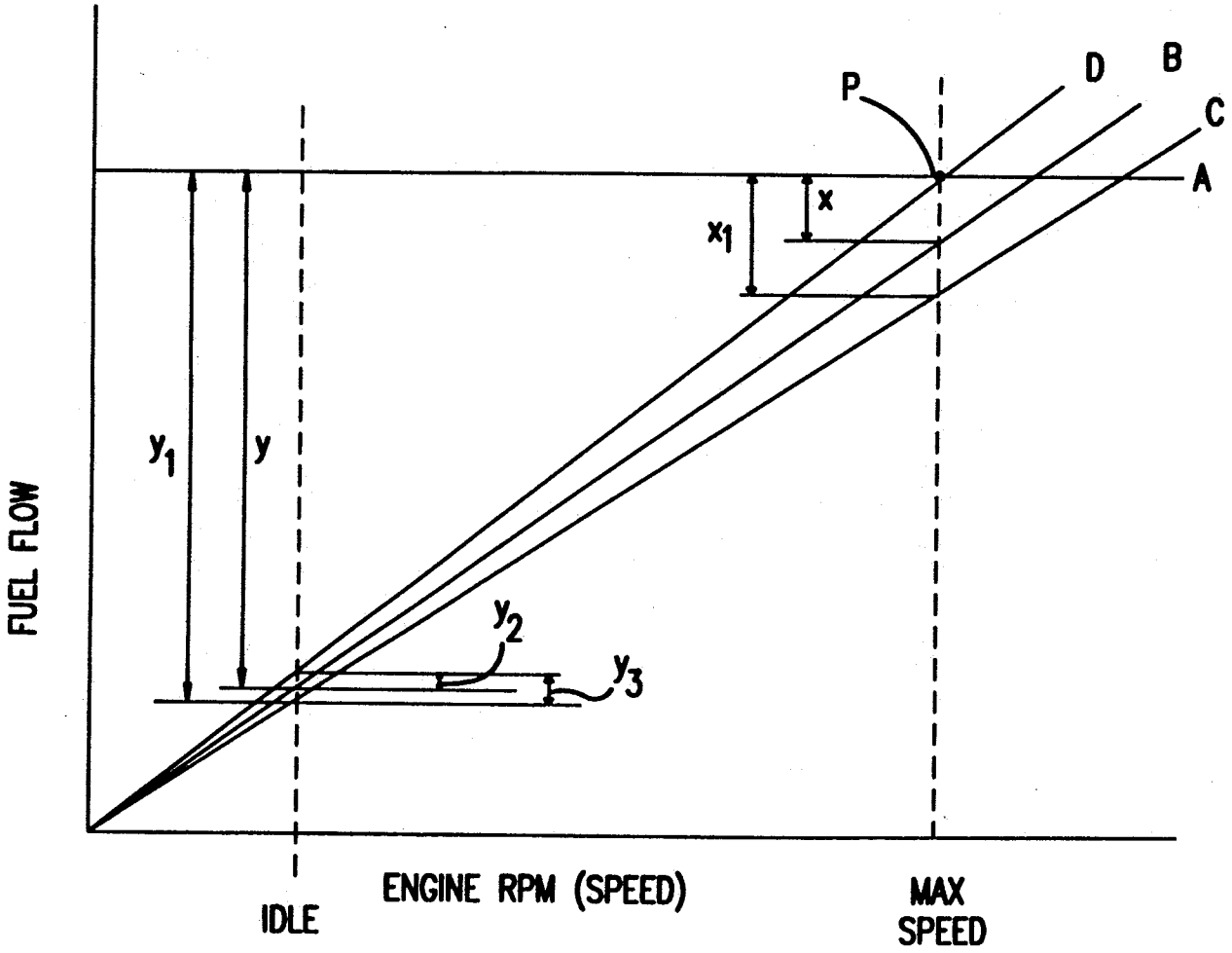
FIG. 5 is a second graph qualitatively illustrating operational characteristics of the invention.

The modifications of the invention shown in FIGS. 1, 3 and 4 are better understood by reference to the graphs of FIGS. 2 and 5 respectively.

FIG. 2 is a graph including a plurality of qualitative engine RPM vs Fuel Flow (consumed and by-passed fuel) curves contrasting the operational characteristic of system 10 of FIG. 1 from that of current EXCESSIVE by-pass systems, as applied to a particular gasoline engine driven vehicle.

In FIG. 2, curve A represents the maximum amount of fuel ever required by the engine, which is the amount of fuel continuously delivered (in current systems) by the vehicle electric fuel pump, at a pressure (30–40 psi) required for proper operation of the fuel injectors and determined by the pressure regulator.

It is assumed that horizontal, strait line curve A of FIG. 2 represents the fuel delivery curve of a pump designed to supply some quantity of fuel more than the maximum amount ever needed for operation. That is, this is the constant quantity of fuel delivered by the pump driven by the 12 volt d.c. motor of current vehicles having the EXCESSIVE by-pass fuel systems. This quantity of fuel is delivered by the pump so long as the voltage applied to the pump motor remains at 12 volts d.c., and until the ignition switch is turned OFF.

Curve B represents the maximum amount of fuel ever actually required by the engine, which would be with all accessories (AC, lights, radio, etc.) ON, it being noted that the quantity of fuel actually required increases in direct proportion to engine speed.

Curve C represents the minimum amount of fuel ever actually required by the engine, which would be under no load conditions, with the vehicle transmission in park, or the vehicle coasting down hill, and all accessories OFF. This is the minimum amount of fuel that must be supplied to the engine to prevent engine stall for lack of fuel.

Obviously, Curves B and C are fuel demand curves applicable to a particular gasoline-fuel vehicle, regardless of the type of fuel system. That is, the engine needs fuel (in varying amounts, depending upon conditions) to operate, without regard to the type of fuel supply system, although Curves B and C are affected by any conditions that affects the combustionability of the fuel/air mixture in the engine cylinders, such as engine condition, fuel volatility, etc.

Curve D represents the designed fuel pump delivery of a system 10 fuel pump driven through a magnetic clutch 15, with the slippage of the clutch controlled by the ECU 34 in a manner such that the pump RPM varies so as to be directly proportional to engine speed.

Since the above curves are qualitative, rather that quantitative, Curves B and C are shown as generally parallel, straight line curves, whereas actual data may result in actual non-parallel curves wherein required fuel is nevertheless directly proportional to engine speed.

The vertical lines in FIGS. 2 X1, X2, X3, and X4 represent the quantity of fuel required to be by-passed, with current EXCESSIVE by-pass systems, while Y1, Y2, Y3, and Y4 represent the amount of fuel to be by-passed in systems embodying this invention. That is, the vertical lines extend along the vertical fuel flow axis, between the engine minimum and maximum required fuel curves C and B and the actual pumped fuel curves A (current system) and D (systems embodying the invention) to illustrate dramatically the EXCESSIVE by-pass referred to above.

Study of the FIG. 2 curves necessarily results in the following observations: The difference between the lesser by-pass of system 10 of FIG. 1 and EXCESSIVE by-pass of current systems is the result of the fact that Curve D is sloped generally parallel to Curves B and C, While Curve A in a horizontal, constant-fuel flow curve not parallel to Curves B and C. That is, EXCESSIVE by-pass system fuel flow is not proportional to engine speed, speed being the major contributor to higher fuel consumption, and FIG. 2, system 10 Curve D converges to meet Curve A only at highest engine speed.

Also, it is important to note the following:

1. In current EXCESSIVE by-pass systems, engine speed is sensed, and an engine speed signal is utilized, but to control the injectors, rather than to control the pump speed to reduce fuel by-pass by reducing fuel pump delivery.
2. It is apparent that in current systems not only do X1 and X2 exceed Y1 and Y2, but they also exceed X3 and X4, primarily because pump speed is constant, pumping maximum fuel regardless of engine speed.
3. The benefit of independent pump motor speed control (by variation of input voltage) and pump speed control (by variation of magnetic clutch slippage) is apparent. That is, by-pass can be maintained at a reasonable quantity by control of d.c. motor speed, with neutral magnetic clutch slippage setting, and slippage adjustment can be varied to accommodate greater or lesser fuel needs for accessory operation, for example.

FIG. 3 is a schematic block diagram similar to FIG. 1 illustrating a second embodiment of the invention, wherein the pump 14 is driven by the engine 18, rather than by a d.c. electric motor, but also through a magnetic clutch 15.

Control of the magnetic clutch slippage may be accomplished in any desired manner, such as by appropriate signals generated in the on-board computer 32 and transmitted through leads 33 and 35, in response to a signal from pressure sensor 23 transmitted to computer 32 through leads 37 and 39.

Alternatively, a separate computer or electronic control unit 34, powered by leads 29/30, can receive signals from pressure sensor 23 through leads 38 and 40, the output signal developed thereby being transmitted to magnetic clutch 15 through leads 41 and 42. With the pump 14 driven by engine 18 through clutch 15, the maximum speed of the pump would be engine speed (RPM). That is, with the magnetic clutch locked (no slippage), therefore, the maximum fuel to be by-passed would be the 15% (designed over-capacity). However, FIG. 3 shows a pressure sensor 23 signalling ECU 34 or 32 such that ECU 32 or 34 controls the clutch slippage to eliminate all by-pass. (no by-pass shown).

Other than as described above, the structure and operation of the FIG. 4 third embodiment is much the same as that of FIGS. 1 and 3.

As stated, the graph of FIG. 2 applies to the second modification of FIG. 3, substantially as it does to the first modification of FIG. 1. The magnetic clutch 15 enhances the control and versatility of the system 10, wherein by-pass of pumped fuel is reduced to a minimum because the fuel delivery curve is sloped (fuel pump delivery is directly proportional to engine speed), as in Curves B, C and D of FIG. 2, rather than horizontal as in Curve A of FIG. 2. Automobile manufacturers should one day realize that there is no need to by-pass most of current EXCESSIVE quantities of fuel pumped to 30–40 psi at no load engine idle operating conditions.

FIG. 4 illustrates a third modification of the invention wherein the magnetic clutch of FIG. 3 is eliminated, along with the structure associated therewith, the pump 14 being simply driven by the engine 18 in any suitable manner—direct gear drive, belt drive, etc., at engine speed or a speed related to engine speed.

More specifically, the invention contemplates that pump 14 of the FIG. 4 embodiment is designed to be capable of producing a fuel flow quantity that is some reasonable percentage in excess of the maximum fuel ever usable in (required by) the engine under the most demanding power requirements, for purposes of safety and to overcome factors such as engine and pump wear and the like. However, since the pump is engine driven, the pumped fuel necessarily will be directly proportional to engine speed.

For purposes of further discussion, let it be assumed that the pump 14 in FIG. 4 is designed to provide a fuel flow 15% greater that the engine requires at any particular engine speed (RPM). For purposes of comparison, let it also be assumed that the fuel pumps for current EXCESSIVE by-pass systems are designed to provide a constant fuel flow 15% in excess of the fuel required by the engine under the most demanding requirements.

Referring now to third embodiment FIGS. 4 and 5, curve A again represents the uniform or constant volume EXCESSIVE fuel flow of the electric fuel pump, such as pump 16 of FIG. 1, of current systems, wherein pumped fuel quantity is not proportional to engine speed. Curve B represents the maximum fuel flow requirements of the engine at maximum power, and curve C represents the minimum power fuel flow. Curve D represents the FIG. 4 engine driven pump designed fuel flow, which is, as explained above, 15% in excess of the maximum engine fuel requirements of curve B.

Since the graph of FIG. 5 qualitatively contrasts fuel flow of current EXCESSIVE by-pass systems from the third embodiment system of FIG. 4, on the same engine, it is again noted that curves A and D must intersect at same point P, since the fuel requirements of any particular engine do not depend upon the fuel supply system design.

It will be understood, from the above assumptions, that in current systems, at maximum speed and power of the engine, the pump delivery curve A is 15% greater that engine requirements, as represented qualitatively by vertical line X in FIG. 5, X being the above-mentioned 15% excess fuel and the amount of fuel by-passed at maximum power and speed.

It is important to note that with existing EXCESSIVE by-pass systems, the amount of fuel required to be by-passed increases greatly, with decrease in engine speed, (note by-pass X and X1 at high speed in comparison to Y and Y1 at low speed). Note further that X and X1 are the same for current systems and the third embodiment of FIG. 4. At low speeds (RPM), the fuel by-pass (Y and Y1, in the current EXCESSIVE by-pass systems) at idle speed is several times greater than the fuel by-pass at maximum speed (X and X1), and several times greater than the amount of fuel being consumed in the engine.

Note, also, that while X and X1 apply to both current systems and the FIG. 4 embodiment, Y and Y1 (current systems) greatly exceed Y2 and Y3 (FIG. 4 embodiment) for the reason that maximum constant flow curve A (current systems) greatly exceeds curve D (FIG. 4 embodiment), except at point P.

Considering first the current EXCESSIVE by-pass systems, with the FIG. 5 qualitative assumptions, it is apparent that, at maximum speed and maximum power, 85% of the pumped fuel is consumed in the engine and 15% is by-passed, while at idle speed maximum power, very little fuel is consumed in the engine and a very high percentage of the pumped fuel is by-passed, which is wasteful and unnecessary.

The above is to be contrasted with the fuel by-pass of the proposed FIG. 4 third embodiment engine driven pump, wherein the pump delivery curve D at maximum speed is 15% greater than engine fuel requirement, as shown by X (the designed over capacity) of FIG. 5. That is, the amounts of fuel by-passed at maximum speed are X and X1, as in current systems, but the amounts of fuel by-passed decreases greatly as engine speed decreases (a direct proportion) so that by-pass fuel at idle speed (Y2 and Y3, Y2 being 15% of fuel pumped) is a significantly lower fuel flow. Also, note that the per cent of fuel being by-passed at maximum speed and at idle is substantially the same regardless of speed.

In summary, it is clear that the by-pass fuel of the proposed FIG. 4 system remains substantially constant regardless of engine speed—that is, the system by-passes the designed 15% at all speeds. In contrast, the current systems by-pass several times more fuel than is consumed at the lower speed ranges. Worth noting is the fact that over the life of most any vehicle, the engine necessarily operates at speeds less than 50% of maximum speed (because of legal speed limits and safety considerations), where the quantity of by-passed fuel of current systems is the highest—and EXCESSIVE.

With the proposed systems, wherein pumped fuel is directly proportional to engine speed, the fuel by-passed at maximum power is only 15% (or other designed excess) regardless of engine speed, FIG. 3 being a system where in the slippage of a magnetic clutch can be controlled so as to eliminate any by-pass of fuel.

Although the invention is particularly adapted for original equipment application, it creates a market independent of original equipment, since it also contemplates the aftermarket conversion, even by a reasonably knowledgeable do-it-yourselfer, of current original equipment EXCESSIVE by-pass injection systems to a system embodying the invention, to incorporate the structure of, or equivalent to, that of the embodiments of FIGS. 1, 3, or 4 so as to function on the principles of FIGS. 2 or 5. That is, the fuel pump supplies a quantity of fuel directly proportional to engine speed, including some desirable percentage excess over the maximum fuel required at any given engine speed, whereby the required by-pass and the problems created by such by-pass, is reduced to a relative constant minimum percentage of pumped fuel. The conversion proposed herein is made possible, in part, by the fact that the invention is adapted for and enables use of much of the prior art original fuel system hardware.

Such proposed aftermarket conversion is similar to the already available conversion of a carburetor fuel system to an electronic fuel injection system, such as by purchase of a conversion kit manufactured and sold by at least one prominent independent aftermarket parts manufacturer. In that case, the fuel injection hardware is simply substituted for the carburetor system hardware, following printed instructions included in the kit.

It is obvious, simply by comparing the description of current systems set forth above, as on pages 1 and 2, with the structures described above of the proposed systems shown in FIGS. 1, 3 and 4, that the contemplated steps for aftermarket conversions of current systems to systems embodying the invention (as would necessarily be described in any conversion kit instructions) are generally as follows:

FIG. 1 Embodiment (a) Remove the current electric motor/pump assembly (generally shown in Ser. No. 07/662,568 as tank mounted motor/pump assembly 16/14.

Figure 6:
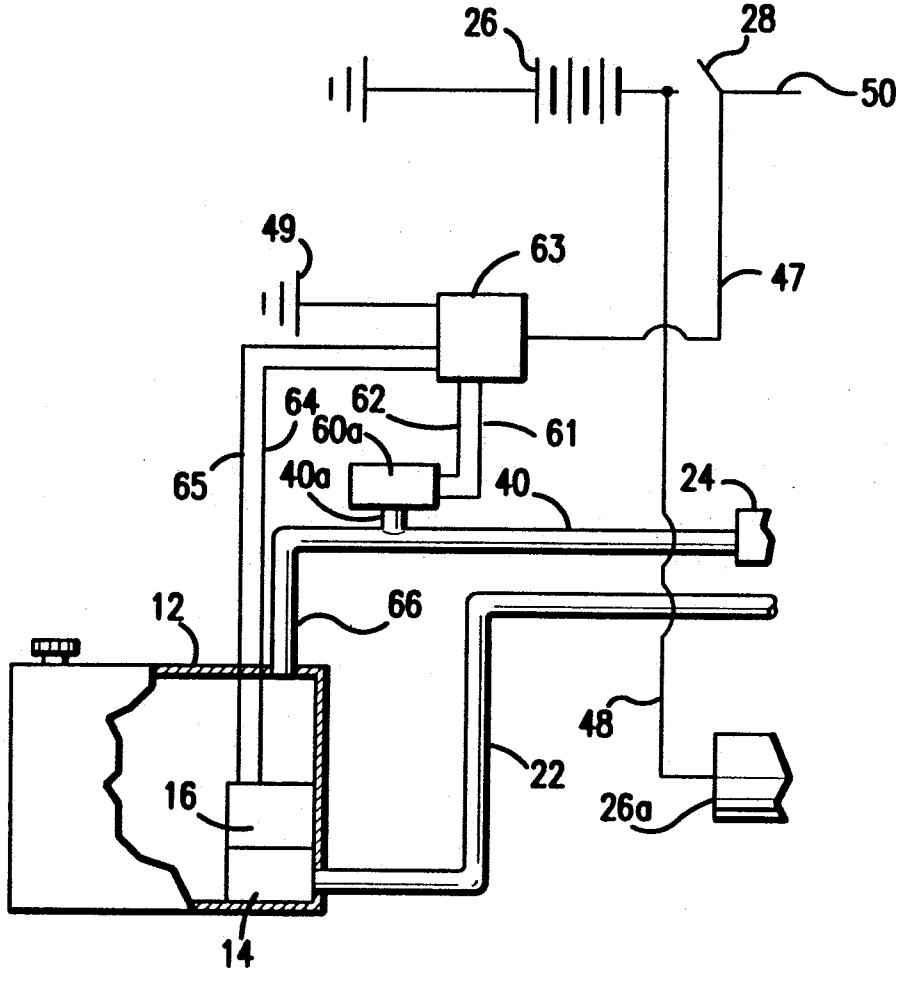
FIG. 6 is a schematic block diagram of a fourth embodiment of the invention comprising a modification of the left hand portion of FIG. 4.

(b) Provide and substitute therefor a preferably unitary electric motor/magnetic clutch/pump assembly 14/15/16, pump assemblies being the common convenient practice, as shown by FIG. 6 pump assembly 1' of U.S. Pat. No. 4,920,942, which includes motor 1*a*, turbin 36 and the pump control unit 20.

(c) Provide any suitable engine speed sensor 43 capable of generating an engine speed output signal and transmitting the same as an input signal to magnetic clutch 15, either directly or through a separate ECU 34, which may be included in computer 32.

The current system being converted may already include an engine speed sensor capable of generating an engine speed output signal, such as engine speed responsive transducer means 43 described at column 5, line 37 of U.S. Pat. No. 4,292,945 referred to in Ser. No. 07/662,568 listed above at page 2, line 28. In that event, as stated herein at page 26, lines 20–23, the current system engine speed sensor (or the output signal therefrom) may be employed in the conversion.

(d) Provide electrical/electronic control circuitry and programs for system performance in accordance with the graph of FIG. 2.

FIG. 3 Embodiment (a) Remove the current electric motor/pump assembly, as described above in step (a) under FIG. 1, substitute an engine-driven magnetic clutch/pump assembly 15/14 and provide an engine drive means therefor.

(b) Eliminate the current by-pass conduit and pressure regulator, such as regulator 24 and conduit 25 of FIG. 1.

(c) Substitute a signal-producing pressure sensor 23 for the pressure regulator 24 of FIG. 1.

(d) Provide electrical/electronic control circuitry and programs for system performance in accordance with the graph of FIG. 2.

FIG. 4 Embodiment (a) Remove the current electric motor/pump assembly, as described in step (a) under FIG. 1.

(b)Substitute therefor an engine-driven pump, including an engine drive means therefor, the pump being designed so as to be capable of delivering a fuel flow quantity such as that described above at page 23, lines 3–11.

(c) Provide electrical/electronic control circuitry and programs for system performance in accordance with the graph of FIG. 5.

It will be noted that each of FIGS. 1, 3 and 4 include injectors 20 electronically controlled by an output signal from a computer 32 and/or an electronic control unit (ECU), which may be part of the computer 32, in response to signals 54*a–e* input thereto from a plurality of any desired sensors 30*a–e*, that sense and signal the instantaneous values of a plurality of engine operating conditions, in response to which engine fuel is to be supplied. While any one of the sensors 30*a–e* may be an engine speed sensor, for generating an engine speed signal for injector control, it is obvious that the FIG. 4 fuel supply system does not require an engine speed sensor, since the pump 14 is driven by the engine, as stated at page 22, lines 28–31.

It is believed that one skilled in the electronics art can provide computer and/or electronic control unit programs and electronic elements and circuitry, as by reference to the many textbooks, technical papers and other reference materials (including the above-referenced U.S. Pat. No. 4,292,945, as well as many other U.S. patents such as those already referred to on page 2 hereof and those now cited as references in U.S. Ser. No. 07/662,568, necessary for converted system performance in accordance with the graphs of FIGS. 2 and 5.

Having described the structure and operation embodiment of the invention illustrated in FIGS. 1-5, as also disclosed in application U.S. Ser. No. 07/726,788, the above mentioned reference is now made to FIGS. 6 and 7 illustrating fourth and fifth embodiments of the invention.

Figure 7:
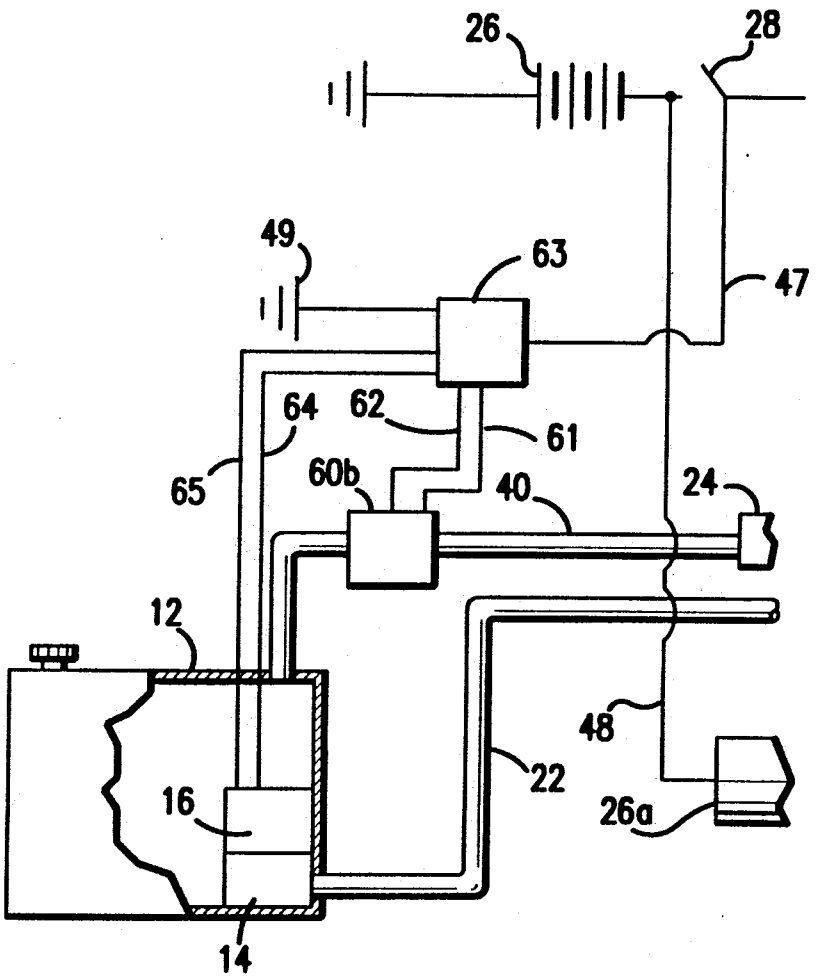
FIG. 7 is a schematic block diagram of a fifth embodiment of the invention comprising a second modification of the left hand portion of FIG. 4.
Figure 8:
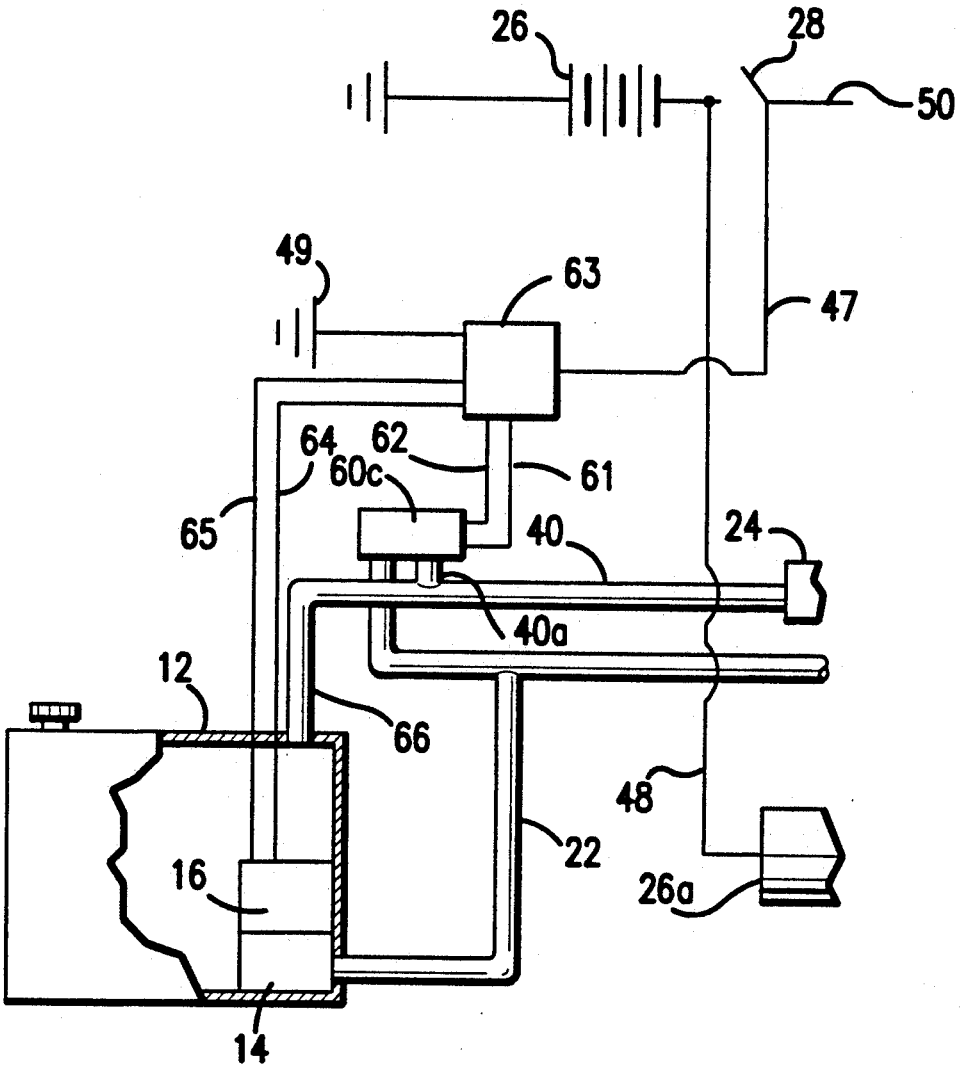
FIG. 8 is a schematic block diagram of a sixth embodiment of the invention comprising a third modification of the left hand portion of FIG. 4.

In contrast to the embodiments of FIGS. 1,3 and 4, the embodiments of FIGS. 6, 7 and 8 are based upon the idea of providing a variable fuel supply system, (in that respect much like the variable fuel supply systems of copending U.S. Ser. Nos. 07/662,568 and 07/726,788) with the in-use prior art system pressure regulator 24 by-passing fuel in excess of the amount of fuel wanted or needed, but providing additional controls to monitor and control the amount of fuel being by-passed.

That is, the systems of FIGS. 6,7 and 8 make use of a variable supply of fuel to not only supply the quantity of fuel required to maintain the correct pressure in the injector supply conduit 22, but to maintain that amount of fuel, plus some "Q" amount of fuel to make sure that the by-pass valve (pressure regulator 24) is always by-passing some minimum amount of fuel. The amount of fuel "Q" is dependent upon and determined by the effect of the transient conditions and the inability of the variable supply systems to maintain the system design fuel pressure in the injector supply conduit 22. This is much like the accelerating pump function in prior art carburetors, wherein the amount of fuel and duration of the pump shot had to be determined to maintain proper operation during the transient condition of accelerating the engine speed. However, this amount of fuel "Q" would be very small, compared to the vast amount of fuel being by-passed in current fuel systems described above.

Prior art fuel supply systems for fuel injection systems do not control the amount of by-pass, at least not to the extent or in the manner contemplated by the invention. Rather, they either by-pass all of the unused fuel from a constant supply pump or have no by-pass at all.

The graph of FIG. 5, which is explained in connection with the system of FIG. 4, applies to the function of the systems of FIGS. 6,7 and 8, as follows:

Curve B represents the maximum fuel that can be used in the engine at max speed and and under full load conditions. Curve C represents the conditions of a free engine in neutral with no accessories operating. Curve D would be the amount of fuel determined necessary to pump to insure that the by-pass valve is by-passing some minimum amount of fuel under the most severe transient conditions. The difference in fuel flow x or y2 is the amount of fuel determined necessary to be by-passed to insure that the pressure in the injector supply line is as designed or specified under the most severe transient conditions.

With prior art in use systems, x1 & y is the amount of fuel by-passed at max and min load, respectively, at idle while with the proposed systems y2 & y3 is the amount of fuel by-passed at max and min load respectively at idle. Likewise with prior art in use systems, x and x1 represent the amount of fuel by-passed at max and min load respectively at max speed (RPM) which is the same for the proposed system.

As can be seen from FIG. 5, the amount of fuel by-passed with the proposed systems is significantly less than prior art in use systems at the lower engine speed ranges where the engine operates most of the time.

It must be noted that in the application of FIG. 5 to the FIG. 4 system, curve D represents the designed output of the pump driven at engine speed. However, in the application of FIG. 5 to the systems of FIGS. 6, 7 and 8, curve D represents the output of the variable speed pump driven at a speed to maintain curve D, which includes the determined amount of fuel to be by-passed.

FIGS. 6 and 7 each include all of the structure illustrated to the right of vertical broken line A—A of FIG. 4, which structure operates as in FIG. 4 but is not shown in FIGS. 6 and 7, for purposes of brevity, except for connecting structures such as conductor 50, fuel return conduit 40, unmetered fuel conduit 22, and alternator 26*a*.

The engine driven pump 14 and the fuel intake and discharge conduits there of of FIG. 4 are not included in FIGS. 6 and 7. The engine driven pump 14 is replaced by fuel tank 12 mounted variable speed d.c. electric motor 16/pump 14 assembly, similar to the motor 16/pump 14 of FIG. 1 but without the magnetic clutch 15 thereof. Of course, motor 16/pump 14 may be mounted outside of the fuel tank 12. Also certain applications may benefit from use of a magnetic clutch 15.

Referring more specifically to FIG. 6, a fuel pressure transducer 60*a*, of any suitable design, is connected to fuel return conduit 40 by a branch conduit 40*a*, the transducer continuously sensing and transmitting instantaneous return fuel pressure (resulting from a restriction 66 and a change in the amount of fuel by-pass at pressure regulator 24 in return conduit 40) as a signal representative of an input to electronic control unit (ECU) 63, through leads 61 and 62.

The ECU 63 having power lead 47 and ground 49 generates and transmits an electric output signal preferably a voltage signal to electric motor 16 through leads 64 and 65, to vary the speed of motor 16 so as to vary the pump 14 speed to maintain the required fuel pressure in the fuel conduit 22 feeding the injector(s) 20.

Referring now to FIG. 7, it will be seen that the structure thereof differs from the structure of FIG. 6 in that the pressure transducer 60*a* of FIG. 6 is eliminated.

Further, a fuel flow transducer 60*b* is connected in the fuel return conduit 40 to continuously sense and transmit a signal of instantaneous return fuel flow to ECU 63 through leads 61 and 62.

In FIG. 7, the ECU 63 also powered through lead 47, generates and transmits an electric output signal (preferably a voltage signal) to electric motor 16 through leads 64 and 65, to vary the speed of motor 16 so as to vary pump 14 speed to maintain flow in by-pass line 40, which insures that the required fuel pressure is maintained in the fuel conduit 22 feeding the injector(s) 20.

In FIG. 8, a differential pressure transducer 60*c* continuously senses the pressure in injector feed conduit 22 through branch conduit 22*b* and the pressure in by-pass conduit 40 through branch conduit 40*a*, and transmits pressure differential signals representative of difference between conduit 22 and conduit 40 pressures to electronic control unit 63 through leads 61 and 62. Unit 63 transmits speed control signals to motor 16/pump 14 assembly through leads 64 and 65, for the same purpose as in FIGS. 6 and 7.

In copending U.S. patent application Ser. No. 07/662,568 filed Feb. 28, 1991, it is proposed that the fuel return be completely eliminated, and the fuel pressure transducer 24 therein is located adjacent to the fuel injector(s) 20, the thought being that the electronic controls would react fast enough to eliminate any problem with inertia, or momentary lag in fuel getting to the injector(s).

For instance, as the injector(s) 20 inject more fuel, the pressure transducer 24 in Ser. No. 07/662,568 could be made to merely instantaneously evaluate the amount of loss of pressure (recognizing small pressure differences between a small change in flow in comparison to a large change in fuel flow) and give the pump the appropriate surge in speed to make up for the loss due to inertia before settling to a new speed for new established fuel flow through the injector(s). That is, if such a deficiency is encountered, it can be over come electronically.

However, if the inertia of a non-bypass fuel system is such that it cannot be overcome electronically, then a controlled minimal by-pass system such as proposed herein can be employed.

Further descriptions of the structure and/or operation of FIGS. 6, 7 and 8 are as follows:

In FIG. 6, the restriction 66 causes a pressure to exist in return conduit 40, and it is sized so as to return the required amount of fuel to take care of any maximum effect of changing fuel flows at a nominal pressure in the return conduit 40. If the return conduit pressure decreases, it is an indication that more fuel is being supplied through the injector(s) (used by the engine) and that the speed of motor 16 should be increased. On increase of pressure in the conduit 40, the ECU 63 would decrease motor 16 speed so that the fuel supplied to the injector(s) would be controlled by motor speed, which would be more (the amount designed to take care of the maximum changing flow effect) than the amount of fuel being supplied to the engine 18 by the injector(s) 20.

That is, whenever the pressure in the return conduit 40 gets too high, indicating that EXCESSIVE fuel is being by-passed, the ECU 63 adjusts motor 16 speed to decrease fuel flow into conduit 22 feeding the injector(s) 20. Conversely, when the pressure in conduit 40 gets too low, the ECU adjusts motor 16 speed to increase flow in conduit 22. In other words, restriction 66 is sized to allow sufficient fuel flow to make sure that the pressure in conduit(s) **22*a* is always at designed pressure, regardless of transient conditions if increased or decreased flow demand. The pressure in conduit 40 and the size of restriction 66** are matched to allow minimum return fuel flow and still take care of all transient conditions. The amount of fuel returned (by-passed) will be minimal, the amount tto assure that the inertia effect on the fuel getting to the injector(s) is eliminated.

Finally, with the FIG. 6 structure, the operation of the injector(s) would not be effected since the designed pressure regulator 24 would be in full operation, with the added restriction 66, ECU 63 and pressure transducer **60*a* functioning to only control the amount of fuel being by-passed through return conduit 40. Whenever the pressure in conduit 40 gets too high indicating too much fuel is being by-passed, the ECU 63 automatically adjusts pump 14 (motor 16) speed to decrease the flow of fuel into the injector feed conduit 22**, and vice versa.

In FIG. 7, the flow sensor **60*b* senses the amount of by-pass fuel flow back to the tank 12 and continuously signals the ECU 63, which, in turn, continuously signals the motor 16, so as to vary pump 14 speed so there is always some amount of by-pass fuel floe "Q", which is predetermined to insure that the injector fuel supply conduit 22** is always at the required pressure, and that the pressure regulator is always by-passing some fuel.

The amount of flow "Q" should be a very small amount since if any flow at all occurs, the system is by-passing fuel that is not needed. That is, flow "Q" is determined so that under the most extreme conditions of inertia, some very small flow "Q" would be recognized by the flow sensor **60*b***, in comparison to the vast amount of fuel by-passed in currently used by-pass systems.

As is the case of FIG. 6, the operation of the injector(s) would not be affected since the design pressure regulator 24 is in full operation.

In FIG. 8, with the restriction 66 in the return conduit 40 and a differential pressure transducer **60*c* connected by branch 40*a* to return conduit 40 and by branch 22*b* injector feed conduit 22, the differential pressure will be monitored and controlled by the ECU 63 to make sure that there is some minimal flow of fuel through the return conduit at all times, which insures that the pressure regulator 24 is functioning to maintain the operation the same as in todays systems. The only difference is that the variable speed pump 14 will produce only the amount of fuel required for the injector(s) 20 plus some predetermined amount "Q" to assure that under transient conditions the pressure in line 22 will not be effected. In other words, as the differential pressure in the differential pressure transducer decreases indicating that less fuel is flowing back to the tank, the ECU 63 will signal the pump 14 to speed up to maintain the proper flow in the return line 40. If the differential pressure in the differential pressure transducer 60*c* increases, the ECU 63 will send a signal to the variable speed motor 16** to slow down to maintain the designed flow in the return line 40.

In all three of these proposals (FIGS. 6, 7 and 8), it is conceded that the flow in the return line 40 may vary some small amount but will have no effect on the metering of the injector(s) since the pressure regulating valve (pressure regulator 24) is always functioning the same as it was in prior art systems. In fact, in today's systems, the flow through the pressure regulating valve 24 varies greatly—from almost the full capacity of the pump at idle to a very small amount at full speed and full power. Further, with the proposed inventions, the flow through the pressure regulating valve will (a) be a minimal amount and (b) vary only slightly—only the amount necessary to compensate for the transient conditions. This then could lead to a design and development of a smaller, simpler and less expensive pressure regulator valve 24 as compared to those used today.

As explained above in connection with FIGS. 1, 3 and 4, the systems of FIGS. 6, 7 and 8 are contemplated for and very easily accomplished, in aftermarket retrofit or conversion of prior art fuel systems, especially EXCESSIVE by-pass systems as referred to herein, as follows:

FIG. 6—Provide an appropriate restriction 66 in by-pass conduit 40, as shown; provide an appropriate pressure transducer **60*a* with branch conduit 40*a* to conduit 40;provide an appropriate ECU 63** with leads 61, 62, 64 and 65, as explained, with power lead 47 and ground 49.

FIG. 7—Provide an appropriate fuel flow transducer 60*b* in fuel return conduit 40; provide and program an appropriate ECU 63 with leads 61, 62, 64 and 65, as explained, with power lead 47 and ground 49.

FIG. 8—Provide an appropriate differential pressure transducer 60*c* and connect the same to by-pass or return conduit 40 and to injector feed conduit 22 by branch conduits 40*a* and 22*b*, respectively; provide an appropriate restriction 66 in by-pass conduit 40 down stream of transducer 60*c*; provide and program an appropriate ECU 63 with leads 61, 62, 64 and 65, as explained, with power lead 47 and ground 49.

Although certain embodiments of the invention have been disclosed and described, it is apparent that other embodiments and modifications of the invention are possible within the scope of the appended claims, no other limitations being intended.

What I claim as my invention is:

1. A fuel supply system for an internal combustion engine having at least one cylinder, said system comprising a fuel tank, a fuel pump driven by a d. c. variable speed electric motor, an electronically operated fuel injector for metering the fuel supplied to the engine cylinder, one or more engine operating condition sensors each generating an electrical output signal representative of an instantaneous engine operating condition, a computer for receiving said sensor output signal(s) and generating an integrated output signal for controlling said fuel injector(s), an injector fuel feed conduit connecting said fuel tank, pump and injector(s), a fuel by-pass or return conduit including a pressure regulating valve for returning to said tank or a sump pumped fuel not required by the engine and thus not injected into the engine by the injector(s), an additional sensor for generating an electrical signal representative of an instantaneous fuel flow condition in said by-pass conduit, an electronic control means for receiving said additional sensor signal and generating an output signal supplied to said d. c. motor for varying fuel pump speed in a manner to not only supply the variable quantity of fuel required by the engine over the entire range of engine operating conditions to maintain the required system fuel pressure in the injector fuel supply conduit but to supply that required amount of fuel plus some additional quantity of fuel "Q" to make sure that the by-pass valve (pressure regulator) is always by-passing some amount of fuel, said system being electronically programmed so that said additional fuel "Q" is dependent upon and determined by the effect of transient conditions and the inability of a variable fuel supply system to maintain the system design fuel pressure in said injector(s) fuel supply conduit, said fuel "Q" being minimal but sufficient to assure that said fuel supply system including said pressure regulating valve is constantly operating as designed and that fuel by-pass is never permitted to reach, and is prevented from ever reaching, a condition of zero by-pass, thereby positively and completely eliminating the danger that the quantity of fuel pumped is less than the quantity of fuel required to be injected into the engine, as could occur in a fuel supply system wherein fuel by-pass were allowed to reach zero at any time, even for an instant.

2. A system such as that recited in claim 1, wherein said by-pass fuel flow condition is by-pass fuel flow quantity and said by-pass conduit includes a fuel flow sensor, said sensor continuously generating a signal representative of the instantaneous fuel flow in said by-pass conduit, said signal being transmitted to an electronic control unit which is programmed to continuously generate and transmit to said pump motor a signal to increase or decrease motor speed as needed to maintain said predetermined minimal fuel quantity "Q", so as to never permit a condition of zero fuel by-pass.

3. A system such as that recited in claim 1, wherein said by-pass fuel flow condition is fuel pressure and said by-pass conduit includes a fuel pressure sensor and a downstream fuel flow restriction, said sensor continuously generating a signal representative of the instantaneous fuel pressure in said by-pass conduit, said signal being transmitted to an electronic control unit which is programmed to continuously generate and transmit to said pump motor a signal to increase or decrease motor speed as need to maintain a predetermined fuel pressure, which assures that said predetermined minimal excess fuel quantity "Q", so as to never permit a condition of zero by-pass.

4. A system such as that recited in claim 1, wherein said by-pass fuel flow condition is the differential between a first fuel pressure in said injector fuel feed conduit and a second fuel pressure in said by-pass fuel conduit, said differential being continuously sensed by a differential pressure sensor to which said first and second pressures are communicated, said sensor continuously generating a signal representative of said instantaneous differential to an electronic control unit, said control unit being programmed to continuously generate and transmit to said pump motor a signal to increase or decrease the speed of said motor as needed to maintain said predetermined minimal excess fuel quantity "Q", so as to never permit a condition of zero fuel by-pass.

5. A method of aftermarket modification, for improved performance and control of reduced fuel by-pass quantity, of an in-use original equipment internal combustion engine fuel supply system having a fuel tank, a fuel pump driven by a d. c. variable speed electric motor, an electronically operated fuel injector for metering the fuel supplied to the engine cylinder, one or more engine operating condition sensors each generating an electrical output signal representative of an instantaneous engine operating condition, a computer for receiving said sensor output signal(s) and generating an integrated output signal for controlling said fuel injector(s), an injector fuel feed conduit connecting said fuel tank, pump and injector(s), a fuel by-pass or return conduit including a pressure regulating valve for returning to said tank or a sump pumped fuel not required by the engine and thus not injected into the engine by the injector(s), said method comprising the following steps:

(a) providing an additional sensor for generating an electrical signal representative of an instantaneous fuel condition in the by-pass conduit, (b) providing an electronic control means for receiving the additional sensor signal, (c) programming the electronic control unit to generate an output signal and supplying such signal to the d. c. motor for varying fuel pump speed in a manner to not only supply the variable quantity of fuel required by the engine over the entire range of engine operating conditions to maintain the required system fuel pressure in the injector fuel supply conduit, but to supply that required amount of fuel plus a predetermined minimal additional quantity of fuel "Q" to make sure that the pressure regulator valve is always by-passing some amount of fuel, and (d) further programming the electronic control unit so that such additional fuel "Q" is dependent upon and determined by the effect of transient conditions and the inability of a variable fuel pressure in said injector(s) fuel supply conduit and so that the fuel "Q" is minimal.

6. The method of claim 5, wherein the sensor of step (a) is a by-pass fuel conduit pressure sensor for generating an electricl signal representative of the instantaneous fuel pressure in the by-pass conduit.

7. The method of claim 5, wherein the sensor of step (a) is a by-pass fuel conduit flow sensor for generating an electrical signal representative of the instantaneous fuel flow in the by-pass conduit.

8. The method of claim 5, wherein the sensor of step (a) is a pressure differential sensor for generating an electrical signal representative of the instantaneous differential between injector supply conduit and by-pass conduit pressures.

9. The method of claim 5, wherein step (a) is providing a by-pass fuel conduit pressure sensor and a downstream flow restriction for generating an electrical signal representative of the instantaneous fuel pressure in the by-pass conduit.

10. A method of aftermarket conversion of an in-use internal combustion engine fuel supply system from (a) one wherein a fuel pump continuously pumps the maximum quantity of fuel that the engine will ever require and a fuel return conduit by-passes back to a fuel tank all of the pumped fuel except the quantity actually supplied to the engine, which at engine curb idle speed is most of the pumped fuel to (b) a system wherein only a minimal quantity of fuel "Q" is continuously by-passed, the fuel by-pass quantity "Q" never being permitted to decrease, and positively being always prevented from decreasing, to the dangerous condition of zero by-pass, said method comprising the following steps:

(1) Adding to the existing fuel by-pass structure a sensor continuously (i) sensing a fuel flow condition in the conduit and (ii) generating an electrical output signal representative of the instantaneous value of the condition, over the entire range of operation of the engine, (2) Providing electronic control means receiving the sensor output signal as an input and generating an electrical output signal, (3) Programming the electronic control means so that the electrical output signal from the control means is representative of a minimal fuel by-pass quantity "Q" that positively cannot ever reach the dangerous zero by-pass fuel flow, and (4) Transmitting the control means output signal to the variable speed electric d. c. motor driving the fuel pump to continuously adjust motor/pump speed and implement the program of step (3) above.

11. The method recited in claim 10, wherein step (1) specifically comprises the addition of a fuel pressure sensor to the fuel by-pass structure.

12. The method recited in claim 10, wherein step (1) specifically comprises the addition of a fuel pressure sensor and a downstream fuel flow restriction to the fuel by-pass structure.

13. The method recited in claim 10, wherein step (1) specifically comprises adding a fuel flow sensor to the fuel by-pass structure.

14. The method recited in claim 10, wherein step (1) specifically comprises adding a differential pressure sensor between the fuel supply and the fuel by-pass conduits.

15. The method recited in claim 10, wherein step (1) specifically comprises adding a differential pressure sensor between the fuel supply and the fuel by-pass conduits and a downstream fuel flow restriction in the fuel by-pass conduit.

16. A method such as that recited in claim 10, wherein programming step (3) is such that said by-pass fuel quantity "Q" is a substantially constant minimal fuel flow that never reaches zero flow, regardless of the quantity of fuel supplied to the engine, over the entire operating range of the engine.

* * * * *